United States Patent [19]

Yato et al.

[11] Patent Number: 4,516,259

[45] Date of Patent: May 7, 1985

[54] SPEECH ANALYSIS-SYNTHESIS SYSTEM

[75] Inventors: Fumihiro Yato; Seishi Kitayama, both of Tokyo; Akira Kurematsu, Yokohama, all of Japan

[73] Assignee: Kokusai Denshin Denwa Co., Ltd., Tokyo, Japan

[21] Appl. No.: 375,356

[22] Filed: May 6, 1982

[30] Foreign Application Priority Data

May 11, 1981 [JP] Japan ..... 56-69388
Sep. 30, 1981 [JP] Japan ..... 56-153578

[51] Int. Cl.[3] ..... G10L 1/00
[52] U.S. Cl. ..... 381/36; 381/30
[58] Field of Search ..... 381/41; 364/29–40, 364/513.5

[56] References Cited

U.S. PATENT DOCUMENTS 3,750,024 7/1973 Dunn et al. ..... 381/41

OTHER PUBLICATIONS

Wong, David Y. et al, "An Intelligibility Evaluation of Several Linear Prediction Vocoder Modifications". IEEE Transactions on Acoustics, Speech, and Signal Processing, vol. ASSP 26, No. 5, Oct. 1978.

*Primary Examiner*—E. S. Matt Kemeny
*Attorney, Agent, or Firm*—David G. Conlin

[57] ABSTRACT

In a speech analysis-synthesis system for the narrow band transmission of a speech signal, speech is separated into a plurality of spectrum information ($K_i$), average ($V_0$) of linear prediction error signal, pitch period (L), voiced/unvoiced decision signal (V/UV), a pseudo exciting signal (I) which is a part of a linear prediction error signal or an impulse response of the same, and a frame information which determines the interval and the duration of the spectrum analyzation, then, in a receive side, the product of said pseudo excitation signal (I) and said pitch period (L), a white noise is switched according to said voiced/unvoiced decision signal (V/UV), and the output of the switch is applied to a synthesis filter which attaches correlation components to an input signal according to spectrum information ($K_i$) to provide synthesized speech.

4 Claims, 8 Drawing Figures

FIRST ANALYZER
COMPARATOR
SELECTOR
MEMORY
SECOND ANALYZER
REGISTER
MAXIMUM DETECTOR
NORMALIZE CIRCUIT
CODER
MODEM
MODEM
DECODER
SYHTHESIS FILTER
1
2
3
4
5
6
13
19
20
21
27
28
29
30
101
102
St
a
b
K1
K2
K10
εt
et
I
V0

SPEECH ANALYSIS-SYNTHESIS SYSTEM

BACKGROUND OF THE INVENTION

The present invention relates to a speech analysis-synthesis system, in particular, relates to such a system of a linear prediction type, for a narrow band transmission of a speech signal.

A linear prediction type speech analysis-synthesis system is advantageous for a high speed digital transmission of a speech signal. The general concept of that linear prediction type speech analysis-synthesis system is that a transmit side separates an input speech signal to an exciting signal and a spectrum information (vocal track information), and said information is transmitted separately. Then, a receive side synthesizes the original speech by attaching a spectrum information received from the transmit side to the exciting information, which is a pulse signal in case of a voiced sound, or a white noise in case of an unvoiced sound. The linear prediction type speech analysis-synthesis system has the features that (1) a spectrum information (vocal track information) is expressed by an all pole filter H(Z):

$$H(Z) = A/\left(\sum_{i=0}^{p} \alpha_i Z^i\right)$$

and that (2) an exciting information in a receive side is either a periodical pulse signal or a white noise, or the combination of those signals. Accordingly, it is enough to transmit the coefficients $\alpha_i$ of an all pole filter, average amplitude or average energy $V_0$ of a speech signal, and the information for indicating whether the speech is a voiced sound or an unvoiced sound (V/UV), for synthesizing a speech in a receive side. In case of an unvoiced sound, a period of a pulse signal which is used as a driving signal is also transmitted.

The fact that the spectrum information is expressed by an all pole filter $$H(Z) = A/\left(\sum_{i=1}^{p} \alpha_i Z^i\right)$$

corresponds to the fact that the speech signal $S_t$ at the designated time can be predicted by p number of preceeding signals $S_{t-i}$ (i=1 through p) in the form of $$\sum_{i=0}^{p} \alpha_i S_{t-i}$$

in the sense of the least square error method. Further, since the prediction in the above sense is possible, there exists a strong correlation between adjacent signals. Said coefficient $\alpha_i$ is called a linear prediction coefficient or a spectrum information.

On the other hand, exciting information is provided by obtaining a linear prediction coefficient from a time series signal $S_t$, providing an exciting signal $\epsilon_t$ which is the difference between the original time series signal $S_t$ and the predicted time series signal $S_t'$, and providing the amplitude and the nature of the exciting information from the value $\epsilon_t$. Alternatively, the exciting signal $\epsilon_t$ is obtained by deleting the adjacent correlation components from the time series signal $S_t$.

In analyzing a speech signal, it is assumed that spectrum information and exciting information are constant in a short duration (for instance 30 msec). Therefore, an input speech signal is picked up through an analyzing window (the width of which is for instance 20 msec), and then, a speech signal within that window duration is analyzed, and the average features in that window of the speech signal are transmitted.

Although a prior speech analysis-synthesis system of a linear prediction type can provide a synthesized speech with enough inteligibility, it is not still satisfactory for differentiating individual speakers. The important reasons for that are that (1) an actual driving signal $\epsilon_t$ can not be approximated by a pulse train in case of a voiced sound although a prior system utilizes a pulse train or a white noise for an exciting signal or a driving signal, and (2) spectrum information is not constant during 20 or 30 msec. That disadvantage might be overcome by transmitting a driving signal or an exciting signal $\epsilon_t$ completely. However, in that case, it takes a rather wide frequency band, and therefore, it does not match with a narrow band transmission.

Further, a prior system has the disadvantage to synthesize an explosive sound (p, t or k), since the analysis window is constant (for instance, the width of the window is 20 msec as mentioned above). However, spectrum information and/or exciting information of an explosive sound is not constant during 20 msec, and it is preferable that the width of the analysis window is less than 5 msec when an explosive sound is analyzed or synthesized. However, if the analysis window is designed to be less than 5 msec for analyzing all the input speeches, a voiced sound is not analyzed clearly. That is to say, a voiced sound has a pitch period, which usually 15 msec, and therefore, if a voiced sound is analyzed with the analysis window less than that pitch period, the result of the analysis is not satisfactory.

SUMMARY OF THE INVENTION

It is an object, therefore, of the present invention to overcome the disadvantages and limitations of a prior speech analysis-synthesis system by providing a new and improved speech analysis-synthesis system.

It is also an object of the present invention, which reproduces clear speech, even when a speech is an explosive sound.

The above and other objects are attained by a speech analysis-synthesis system comprising a transmit side and a receive side; said transmit side comprising (a) an input terminal for receiving an input speech signal, (b) spectrum analysis means for analyzing said input speech signal to provide spectrum information ($K_i$), (c) means for providing an average ($V_0$) of linear prediction error signal, (d) means for deriving a basic period (L) of a pitch of an input speech signal, (e) means for deriving a voiced/unvoiced decision signal V/UV according to whether an input speech signal is a voiced sound or an unvoiced sound, (f) a coder for coding said spectrum information, said average ($V_0$), said basic period (L), said voiced/unvoiced decision signal (V/UV), to transmit a coded speech signal; said receive side comprising (g) a decoder for decoding the coded speech signal, (h) a switch for switching a product of the pitch period (L) and an exciting signal, and a white noise, (i) a synthesis filter which receives a driving signal which is obtained according to the output of said switch and said average of linear prediction error signal, and attaches correlation information to said driving signal according to said spectrum information, (j) an output terminal coupled with an output of said synthesis filter, to provide a synthesis speech; said transmit side further comprising means for providing pseudo exciting signal (I) which is obtained from said linear prediction error signal from the output of the spectrum analyzing means, and said pseudo exciting signal (I) is used as an exciting signal for driving the synthesis filter on a receive side.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figures 1, 1A, 1B:
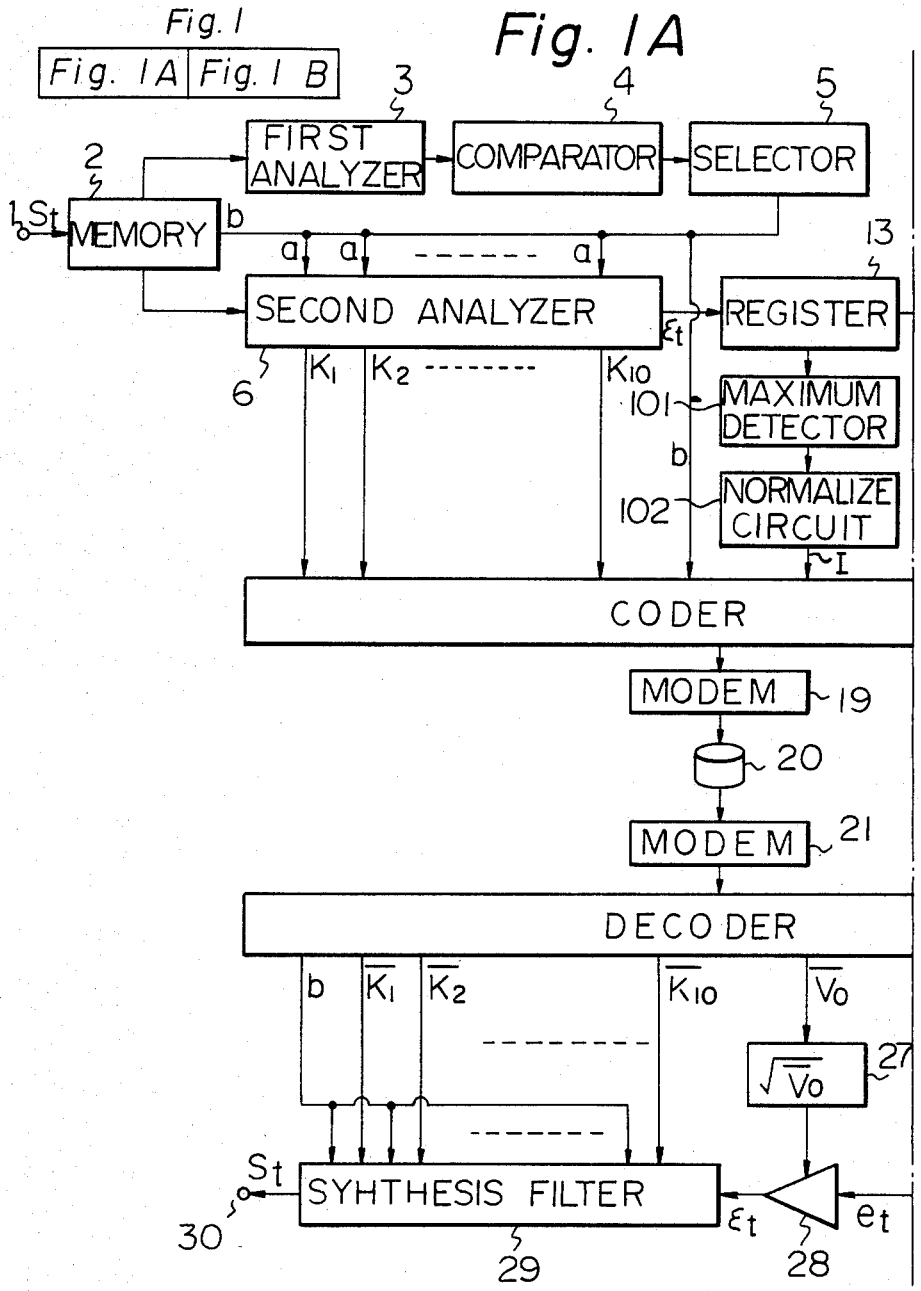
FIG. 1 is a block diagram of the speech analysis-synthesis system according to the present invention, FIG. 1A diagrammatically illustrated the composition of block 1A of FIG. 1.
FIG. 1B diagrammatically illustrates the composition of block 1B of FIG. 1.
Figure 1B:
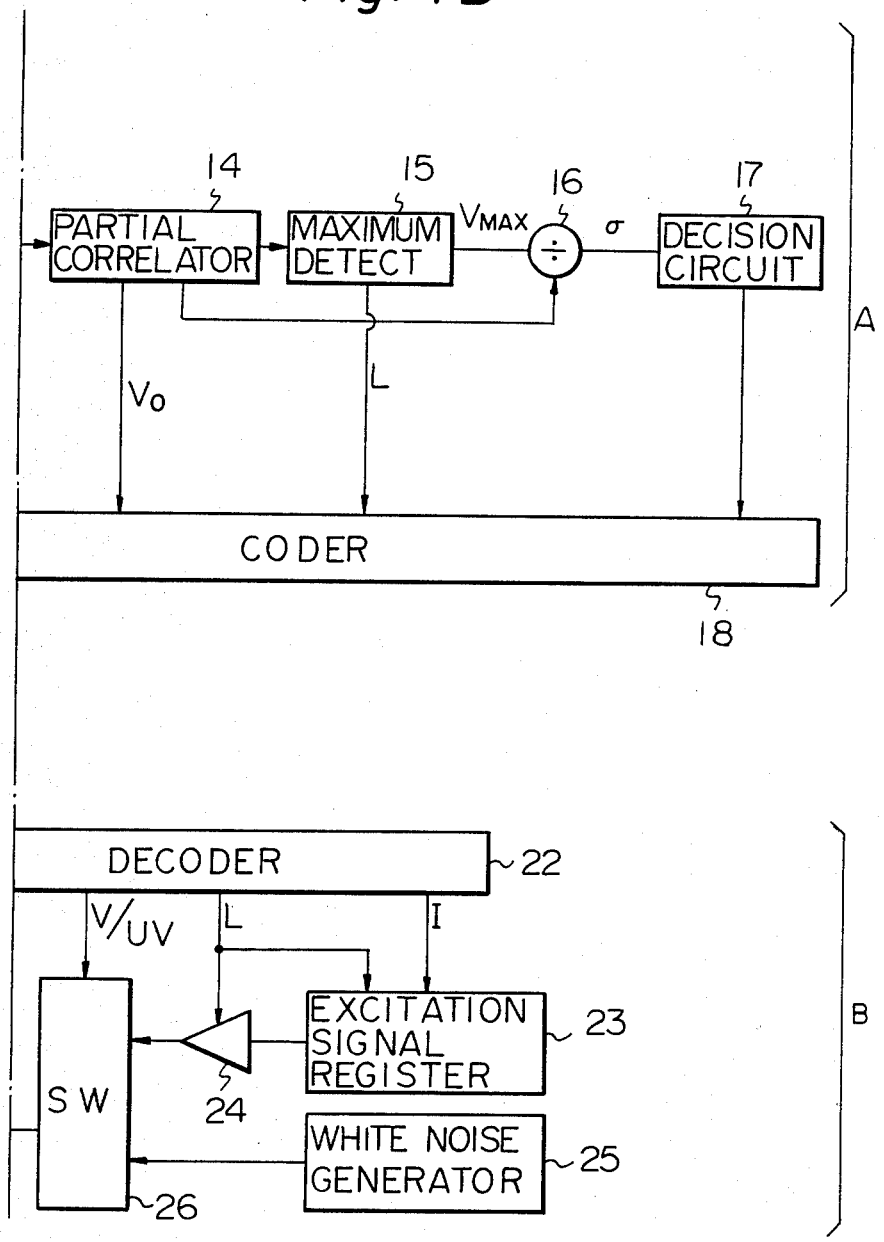

FIG. 1 shows a block diagram of the speech analysis-synthesis system according to the present invention. The system has an analysis portion A, and a synthesis portion B. The analysis portion A analyzes a speech, then, the analyzed speech is transmitted to the synthesis portion B through a modem 19, a transmission line 20, and another modem 21. Then, the synthesis portion B synthesizes the reception signal, and reproduces an original speech.

The analyzing portion A has an input terminal 1 which receives an input speech signal in a digital form, a memory 2 for storing temporarily an input speech, a first analyzer 3 which has some partial correlators, a comparator 4, a selector 5 which provides a frame information for defining the width (a) of an analyzing window, and the interval (b) between each analysis operation. The analyzing portion A has also a second analyzer 6 which has also some partial correlators, the number of which is for instance 10. It should be noted that the second analyzer 6 has more partial correlators than the first analyzer 3 has. The second analyzer 6 provides spectrum information ($K_i$) and the linear prediction error signal $\epsilon_t$, by removing the low degree correlation components from an input speech signal.

Figure 2A:
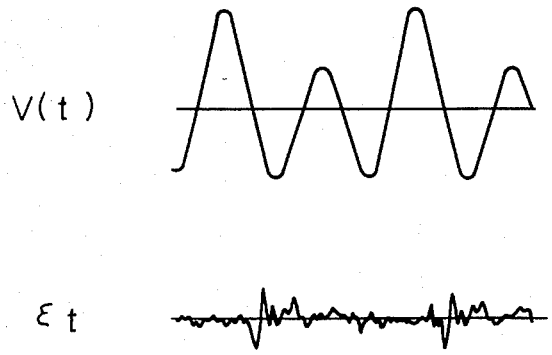
FIG. 2 shows curves of the examples of linear prediction error signal.
FIG. 2B shows some examples of linear prediction error signal $\epsilon_7$ for an input signal V(t) of an unvoiced sound.
Figure 2B:
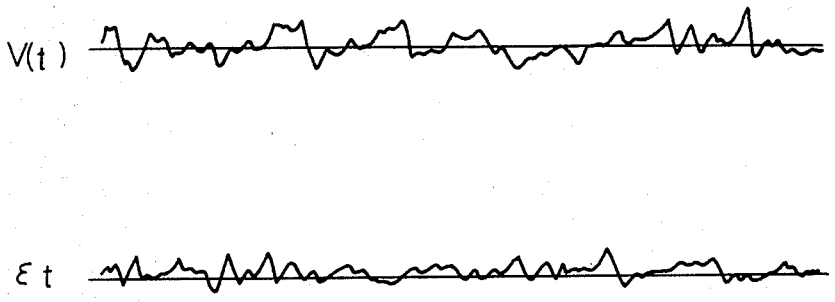

FIG. 2A shows some examples of the linear prediction error signal, $\epsilon_t$ for an input signal V(t). FIG. 2(*a*) shows the case of a voiced sound, and FIG. 2(*b*) shows the case of an unvoiced sound. It should be noted in FIG. 2A that a linear prediction error signal $\epsilon_t$ is periodical in case of a voiced sound or a vowel sound, and that linear prediction error signal is close to a white noise in case of an unvoiced sound or consonant.

The reference numeral 13 in FIG. 1 is a register for storing said linear prediction error signal $\epsilon_t$, the reference numeral 14 is a partial correlator which provides the correlation for every frame interval determined by the selector 5. The correlation $V_0$ of the zero degree is applied to a coder 18 and the divider 16, and other correlations are applied to the maximum value detector 15, which determines the maximum correlation $V_{MAX}$ among all the correlations except that of zero degree, and the degree L of the correlation for providing the maximum correlation $V_{MAX}$.The divider 16 provides the ratio $\sigma = V_{MAX}/V_0$ which gives the figure of periodicity. The decision circuit 17 provides the output "1" when the value "$\sigma$" is equal to or larger than 0.5, recognizing that speech is a voiced sound, and that decision circuit 17 provides the output "0" when the value "$\sigma$" is less than 0.5, recognizing that speech is not a voiced sound. The output of the decision circuit 17 is applied to the coder 18 as the voiced/unvoiced indicator signal V/UV.

The reference numerals 101 and 102 are a maximum value detector and a normalize circuit, respectively, for providing the pseudo exciting signal I.

The presence of the maximum value detector 101 and the normalize circuit 102 in FIG. 1 for providing the pseudo exciting signal is the important feature of the present invention. Those circuits function to transmit a part of the linear prediction error signal $\epsilon_t$, instead of a pulse train in a prior art. Alternatively, an impulse response of that part of the linear prediction error signal may replace said part of the linear prediction error signal.

The maximum value detector 101 detects the maximum level among the consecutive N number of sampling levels in each linear prediction error signal $\epsilon_t$ which is stored in the register 13. Then, the normalize circuit 102 normalizes the N number of data by dividing the same with said maximum level.

According to our experiment, when the value N is 15, about 70% of the energy of the linear prediction error signal in each basic pitch period is included in the consecutive N number of samples. Therefore, the value N is selected so that $N \geqq 15$ is satisfied.

It should be appreciated that when the sampling frequency is 8 kHz, and the basic pitch period is 20 msec, the number of the total sampling points is 160 ($=20/0.125$, $0.125=1/8000$). Therefore, if all the linear prediction error signals were transmitted, the 160 data must be transmitted, while according to the present invention, only $N=15$ data are enough. Further, it is preferable that N is less than 20, since the pitch period of the highest voice is about 2.5 msec ($2.5/0.125=20$), so that only a single pitch information is transmitted.

Figure 6:
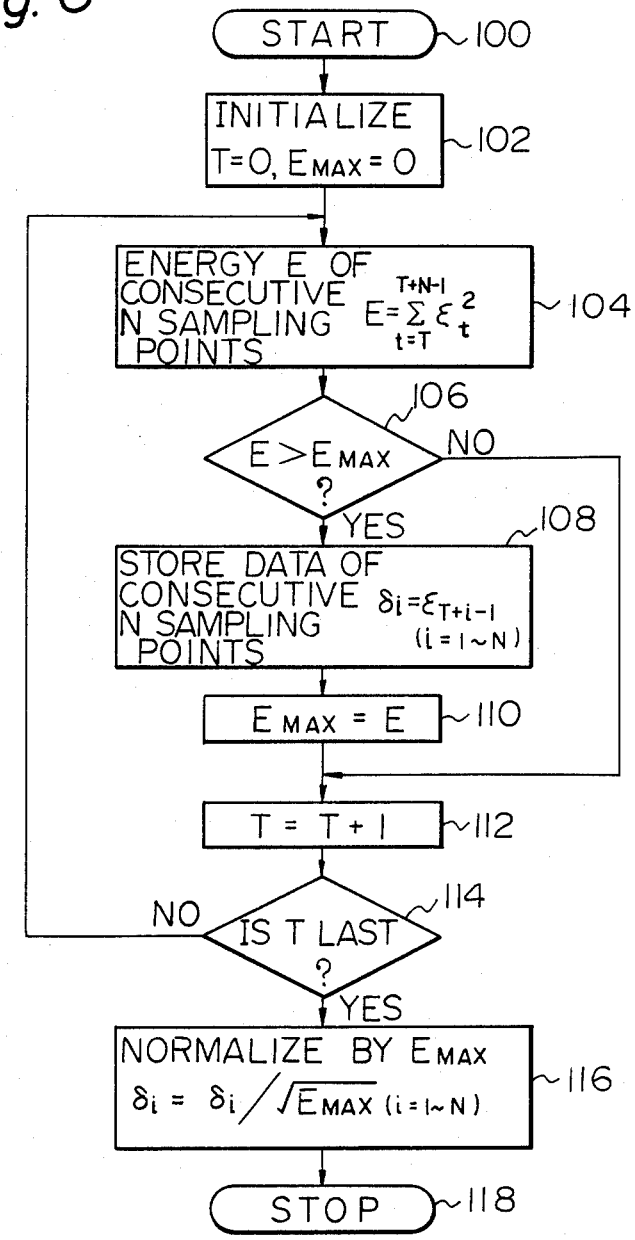
FIG. 6 is a flow diagram of the operation of the maximum detector 101 and the normalize circuit 102 in FIG. 1.

FIG. 6 shows a flow diagram of the operation of the circuits 100 and 102. In FIG. 6, the box 100 shows the start of the operation, the box 102 shows the initialization of the circuit by putting $T=0$ and $E_{MAX}=0$. The box 104 calculates the sum of the energy at the consecutive N number of points. The box 106 compares the sum of the calculated energy E with the maximum energy $E_{MAX}$. The box 108 stores the energy at each of the points. The box 110 replaces the maximum energy $E_{MAX}$ with the calculated energy E. The box 112 increments the step T to $T+1$. The box 114 tests if the value T is the last one, or the value T is the N'th one. The box 116 normalizes each energy by dividing the same by the maximum energy $E_{MAX}$. The box 118 shows the end of calculation.

The partial correlations or the spectrum information $K_i$, which are determined by the second analyzer 6, the average energy $V_0$ of the linear prediction error signal or the correlation of zero degree provided by the partial correlator 14, the indicator V/UV which indicates whether speech is a voiced sound or an unvoiced sound, the information L which indicates the basic pitch period, and the pseudo exciting signal I are applied to the coder 18 for every predetermined analysis interval, which is determined by the members 3, 4 and 5. Then, the coder 18 codes those input signals, which are transmitted to the receive side through the transmission line 20.

Next, the decision of the width of the window for each analysis and the interval between each analysis is described. That decision is accomplished by the first analyzer 3, the comparator 4 and the selector 5.

The first analyzer 3 receives the input speech signal series $x_n$ in a digital form from the memory 2. That data $x_n$ is transferred to the first analyzer 3 by a predetermined duration LL, for instance 20 msec of data. Then, the first analyzer 3 provides the short time partial correlation coefficient $r_t$ according to the equation below.

$$r_t = \left( \sum_{0}^{LL-1} x_n x_{n-1} \right) / \left( \sum_{0}^{LL} x_n^2 \right)$$

Then, the first analyzer 3 receives the next sampling data series $x_n'$ from the memory 2. That sampling data series $x_n'$ has the duration LL (for instance, 20 msec) beginning after the predetermined delay time M (for instance, 15 msec) from the first sampling data $x_n$ and calculates $r_t'$.

Then, the comparator 4 provides the increment $\Delta r_t$ of said correlation coefficient $r_t$ in a short time (for instance, 15 msec), according to the equation below.

$$\Delta r_t = |r_t - r_t'|$$

That increment $\Delta r_t$ is applied to the selector 5.

Then, the selector 5 determines that width (a) of the window for the analysis, and the interval (b) of the analysis according to the value $\Delta r_t$, and the statistical fact that the variance ($\sigma$) of $\Delta r_t$ is 0.06. For instance, the width (a) of the window, and the interval (b) of the analysis for each variance is given by the following table.

| Variance | Width (a) of window | Interval (b) between each analysis |
|---|---|---|
| 0–1($\sigma$) | 30 msec | 20 msec |
| 1($\sigma$)–2($\sigma$) | 15 msec | 10 msec |
| larger than 2($\sigma$) | 7.5 msec | 5 msec |

The results (a) and (b) compose a frame information which is output from the selector 5.

The result (a) of the width of the window is applied to each of the partial correlators in the second analyzer 6, and the result (b) of the period of the analysis is applied to the memory 2 for determining the period for reading out the memory 2.

Then, the second analyzer 6 which has a plurality of (for instance, 10) partial correlators, analyzes the input speech according to the width (a) of the window, and the analyzed results or the spectrum information $K_1$, through, $K_{10}$ are applied to the coder 18. The second analyzer 6 also provides the linear prediction error signal $\epsilon_t$, which is used as a driving signal in a synthesis phase to the register 13. The memory 2, then, cancels the content relating to the first analysis period according to the period (b), so that the memory 2 can provide the sampling data for the next analysis.

In the above description, the short time partial correlation of the first degree is used in the first analyzer 3 for detecting the sudden change of spectrum and/or exciting signal of an input speech. Alternatively, that sudden change can be detected by using an average energy of speech in a short time, or an average number of zero crosses of a speech signal.

Next, the synthesis portion B receives the data from the analysis portion A through the modem 21, and the received data is decoded by the decoder 22 to the partial correlations $\bar{k}_i$ or the spectrum information (i=1–10), the average energy $\bar{V}_0$ of the linear prediction error signal, the basic pitch period L, the voiced or unvoiced indicator V/UV, and the pseudo exciting signal I.

The exciting signal register 23 stores that pseudo exciting signal I, and outputs the information I for every basic pitch period L. The amplifier 24 amplifies that information I by L times, where L is the basic pitch period for the analysis. Those members 23 and 24 are used for providing an exciting signal or a driving signal for synthesizing a voiced sound. The white noise generator 25 is provided for providing an exciting signal for synthesizing an unvoiced sound. The switch 26 switches the output of the amplifier 24 and the output of the white noise generator 25 according to the voiced-/unvoiced indicator V/UV, and provides the exciting information $e_t$. Of course, the output of the amplifier 24 is selected in case of a voiced sound, and the white noise is selected in case of an unvoiced sound (consonant).

It should be appreciated that a prior system has merely a pulse generator instead of the exciting signal register 23 of the present invention. It is one of the feature of the present invention that a pseudo exciting signal I is transmitted from a transmit side, and that signal I is used as a driving signal in a receive side.

The square root circuit 27 converts the average energy $\bar{V}_0$ of the linear prediction error signal to the amplitude level. The amplifier 28 amplifies the exciting signal $e_t$ by $\sqrt{\bar{V}}$HD 0, and the output of the amplifier 28 is applied to the synthesis filter 29 as a driving signal $\bar{\epsilon}_t$.

The synthesis filter 29 which has the coefficients $\bar{k}_i$ equal to the partial correlations $k_i$ analyzed in the transmit side receives that driving signal $\epsilon_t$, and then, the correlation components $\bar{k}_i$ are attached to that driving signal in the opposite manner to that of the analysis phase in the transmit side to provide the synthesized speech $\bar{S}_t$ in a digital form. Then, that digital speech is converted to an analog form by a digital-analog converter (not shown), and then, a synthesized analog speech $\bar{v}(t)$ is obtained through a low pass filter (not shown).

Figure 3:
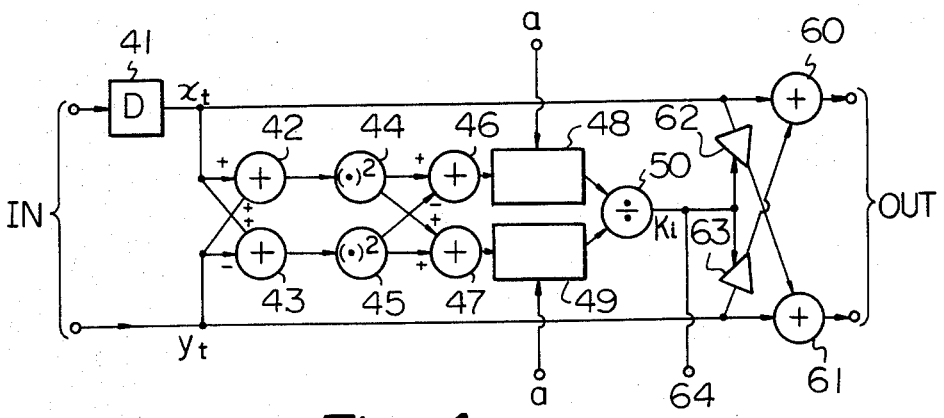
FIG. 3 is a block diagram of a partial correlator utilized in a spectrum analyzer in FIG. 1.

FIG. 3 shows a block diagram of each partial correlators in the first analyzer 3 or the second analyzer 6. The second analyzer 6 has a plurality of (for instance, 10) partial correlators of FIG. 3, and the first analyzer 3 has one or two partial correlators of FIG. 3.

The partial correlator of FIG. 3 has an input terminal IN, a delay circuit 41 which gives a signal a unit delay time equal to a sampling period, a pair of adders 42 and 43, a pair of square circuits 44 and 45, another pair of adders 46 and 47, a pair of average filters 48 and 49, a divider 50, a pair of multiplicators 62 and 63, a pair of adders 60 and 61, and an output terminal OUT.

When an input signal $x_t$ and $y_t$ are applied to the input terminal IN, the adder 46 provides the output $4x_ty_t$, and the adder 47 provides the output $2x_t^2+2y_t^2$. Those values are the correlation component and the energy of the signals $x_t$ and $y_t$, respectively.

The average filters 48 and 49 are a kind of a low pass filter, which provides the average value of an input signal for a given duration (a), where the value (a) is the width of the analysis window provided by the selector 5 of FIG. 1. Therefore, the outputs of the average filters 48 and 49 are the average values $E[4x_ty_t]$, and $E[x_t^2+y_t^2]$, respectively. The divider 50 provides the ratio of the outputs of the average filters 48 and 49, to provide the normalized correlation component $k_i$, which is equal to a partial correlation. The partial correlation $k_i$ is applied to the coder 18 through the output terminal 64. A pair of multiplicators 62 and 63, and a pair of adders 60 and 61 function to remove the correlation component $k_i$ from the input signals $x_i$ and $y_i$ for the input signal of the next stage of partial correlation ($k_{i+1}$).

Figure 4:
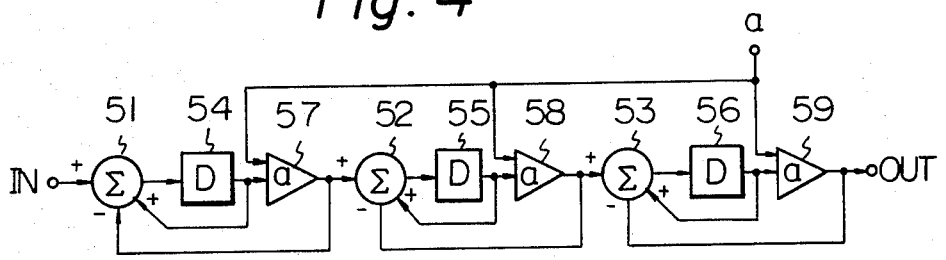
FIG. 4 is a block diagram of an average filter utilized in a partial correlator in FIG. 3.

FIG. 4 is a block diagram of an average filter 48, and/or 49. In the figure, IN is an input terminal, 51, 52 and 53 are an adder, 54, 55 and 56 are a delay circuit for providing a delay time equal to one sampling time, 57, 58 and 59 are a multiplicator, and OUT is an output terminal. The average filter of FIG. 4 is a digital low pass filter to average an input signal.

Figure 5:
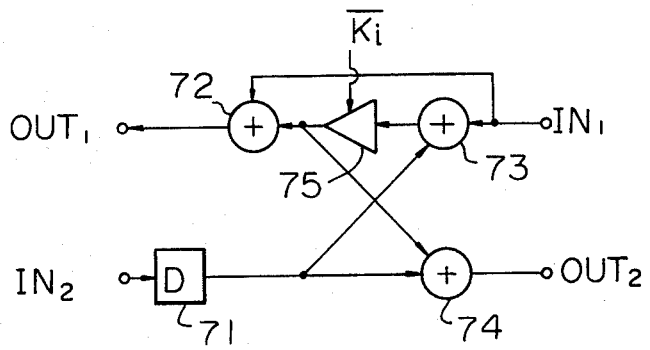
FIG. 5 is a block diagram of a synthesis filter utilized in a system of FIG. 1.

FIG. 5 is a block diagram of one stage of a synthesis filter 29. The filter 29 in FIG. 1 has a plurality of (for instance, 10) units circuits each of which is shown in FIG. 5. In FIG. 5, the reference numeral 71 is a delay circuit for providing a delay time equal to a unit sampling time, 72, 73 and 74 are adders, and 75 is a multiplicator for providing the product of the input signal of the same and the partial correlation $\bar{k}_i$. The synthesis filter of FIG. 5 functions to attach a correlation component $\bar{k}_i$ to an input signal (driving signal).

As described above, the present system can provide the excellent synthesized speech, and the necessary addition for the improvement to the system is very small. Further, since the window width and the analysis interval are adjusted according to the input speech, both an explosive sound and a voiced sound are synthesized with excellent quality.

From the foregoing, it will now be apparent that a new and improved speech analysis-synthesis system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A speech analysis-synthesis system comprising:

a transmit side comprising:

(a) an input terminal for receiving an input speech signal, (b) spectrum analysis means for analyzing said input speech signal to provide spectrum information ($K_i$), (c) means for providing an average ($V_0$) of linear prediction error signal, (d) means for deriving a basis period (L) of a pitch of an input speech signal, (e) means for deriving a voiced/unvoiced decision signal V/UV according to whether an input speech signal is a voiced sound or an unvoiced sound, (f) means for detecting a maximum level of said linear prediction error signal, (g) means for normalizing said linear prediction error signal by dividing said signal by said maximum level to provide a pseudo exciting signal (I), (h) a coder for coding said spectrum information, said average ($V_0$), said basic period (L), said voiced/unvoiced decision signal (V/UV), and said pseudo exciting signal (I) to transmit a coded speech signal, a receive side comprising:

(i) a decoder for decoding the coded speech signal, (j) a switch for switching a product of the pitch period (L) and said pseudo exciting signal (I), and a white noise, (k) a synthesis filter which receives a driving signal which is obtained according to the output of said switch and said average of linear prediction error signal, and attaches correlation information to said driving signal according to said spectrum information, and (l) an output terminal coupled with an output of said synthesis filter to provide a synthesis speech, said pseudo exciting signal being used as an exciting signal in said receive side.

2. A speech analysis-synthesis system according to claim 1, wherein said transmit side further comprises means for determining a period and interval of spectrum analyzation in said analyzing means.

3. A speech analysis-synthesis system according to claim 1, wherein said pseudo exciting signal (I) is an impulse response of said linear prediction error signal provided by the spectrum analyzing means.

4. A speech analysis-synthesis system according to claim 1, wherein said spectrum analysis means has a plurality of partial correlators.

* * * * *